United States Patent [19]

Simington

[11] 4,005,564

[45] Feb. 1, 1977

[54] BRIDLE BIT

[76] Inventor: Donald L. Simington, P.O. Box 401, Calabasas, Calif. 91302

[22] Filed: May 27, 1975

[21] Appl. No.: 581,418

[52] U.S. Cl. ..... 54/8

[51] Int. Cl.[2] ..... B68B 1/06

[58] Field of Search ..... 54/8, 7

[56] References Cited

UNITED STATES PATENTS

| | | | |
|---|---|---|---|
| 392,998 | 11/1888 | Edwards | 54/8 |
| 402,608 | 5/1889 | McKenney | 54/8 |
| 1,070,771 | 8/1913 | Cahill | 54/8 |
| 1,091,683 | 3/1914 | Mateer | 54/8 |
| 2,012,705 | 8/1935 | Bergen | 54/8 |

*Primary Examiner*—Hugh R. Chamblee
*Attorney, Agent, or Firm*—Clarence A. O'Brien; Harvey B. Jacobson

[57] ABSTRACT

A bridle bit having an elongated mouthpiece pivotally attached at opposite ends to bridle rings permitting attachment of a bridle to the bit. The mouthpiece is constructed from a pair of longitudinally extending, substantially rigid arms, each connected to a respective one of the bridle rings, and connected to the arms by separate ball and socket joints permitting universal movement between the coupling member and the respective arms. Between the joints, the coupling member has a substantially cylindrical surface on which is rotatably and slidably arranged a roller which cooperates with the joints to provide a smooth action and freedom of movement of the bit that will permit the bit to function as a pacifier and eliminate such objectionable mannerisms by a horse as tongue protruding, teeth grinding, and lip smacking, frequently caused by extreme nervousness of a horse.

4 Claims, 4 Drawing Figures

BRIDLE BIT

BACKGROUND OF THE INVENTION

1. Field of the Invention

This invention relates generally to a bridle bit, and particularly to a jointed bit usually referred to as snaffle.

2. Description of the Prior Art

It is extremely important in the English equestrian horse show business, and especially at the time that these horses are to perform, that the horse be pacified and removed from nervousness so as to prevent the horse from grinding its teeth, smacking its lips, and chewing on objects within their reach. In order to eliminate such nervousness, it is customary to employ a jointed bit referred to as a snaffle. Such bits, or snaffles, have long been known, and examples of snaffles may be found in U.S. Pat. Nos. 97,022, issued Nov. 23, 1869 to A. P. Baldwin; 103,103, issued May 17, 1870 to J. A. Swan; 109,145, issued Nov. 8, 1870 to B. S. Roberts; and 557,862, issued Apr. 7, 1896 to E. M. McCulloch et al.

While the aforementioned patents disclose snaffles which include mouthpiece members, or arms, which are merely pivotally joined together, U.S. Pat. Nos. 3,623,294, issued Nov. 30, 1971 to W. T. Stone et al., and 3,745,743, issued July 17, 1973 to H. A. Sprenger, disclose examples of snaffles wherein the mouthpiece members are connected together for universal movement. In particular, U.S. Pat. No. 3,623,294 discloses an arrangement wherein the mouthpiece members are connected to an intermediate, or center member, for central universal movement with respect to the intermediate member. These latter mentioned snaffles, however, do not provide quite the freedom of movement and pacification necessary to relieve the nervousness of an equestrian show horse down to such minimum levels as to assure elimination of undesirable habits on the part of the animals during the time they are performing.

SUMMARY OF THE INVENTION

It is an object of the present invention to provide a jointed bridle bit which is substantially more effective than conventional English snaffles currently in use.

It is another object of the present invention to provide a jointed bit, or snaffle, having greater freedom of movement and smoother action than known bits of this kind.

It is still another object of the present invention to provide a jointed bit, or snaffle, that will more effectively act in the manner of a pacifier when compared to conventional bits of this kind.

These and other objects are achieved according to the present invention by providing a jointed bit, or snaffle, which includes an elongated mouthpiece provided at opposite ends with rings, and the like, for facilitating attachment of the bit to a bridle, wherein the mouthpiece has: a pair of longitudinally extending, substantially rigid arms, each of the arms being connected to a respective one of the aforementioned bridle rings; and a center coupling member both between and connected to the arms. According to the invention, the mouthpiece further includes separate, spaced universal joints for connecting the center coupling member to each of the arms for universal movement between the coupling member and the respective arm.

According to a preferred embodiment of the present invention, each of the universal joints includes a ball and socket joint integral with the coupling member and attachably connected to the associated mouthpiece. Advantageously, each of the ball and socket joints includes a ball integral with the coupling member, and a socket mating with the ball and having a screw threaded shank extending directly away from the socket, and an opening of the socket, with each of the arms being provided with a screw threaded bore threadingly engaged with the screw threaded shank of the socket of an associated ball and socket joint for connecting the socket to the respective one of the arms.

The coupling member also includes, according to an advantageous feature of the present invention, a substantially cylindrical surface disposed between, and rigidly connected to, the balls of the universal joints. A roller is rotatably and slidably arranged on the cylindrical surface, with the roller cooperating with the universal joints to provide a smooth action and freedom of movement of the bit that will permit the bit to function as a pacifier and eliminate such undesirable habits as tongue protruding, teeth grinding, and lip smacking, commonly encountered with equestrian show horses due to extreme nervousness of a horse during a show.

The roller rotatably and slidably arranged on the substantially cylindrical surface of the coupling member is preferably annular in shape and provided with a generally cylindrical outer periphery. This generally cylindrical outer periphery of the roller can be knurled, and the like, to increase the friction of the outer periphery of the roller, which will be appreciated will be arranged in the mouth of a horse on which the bit is used.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
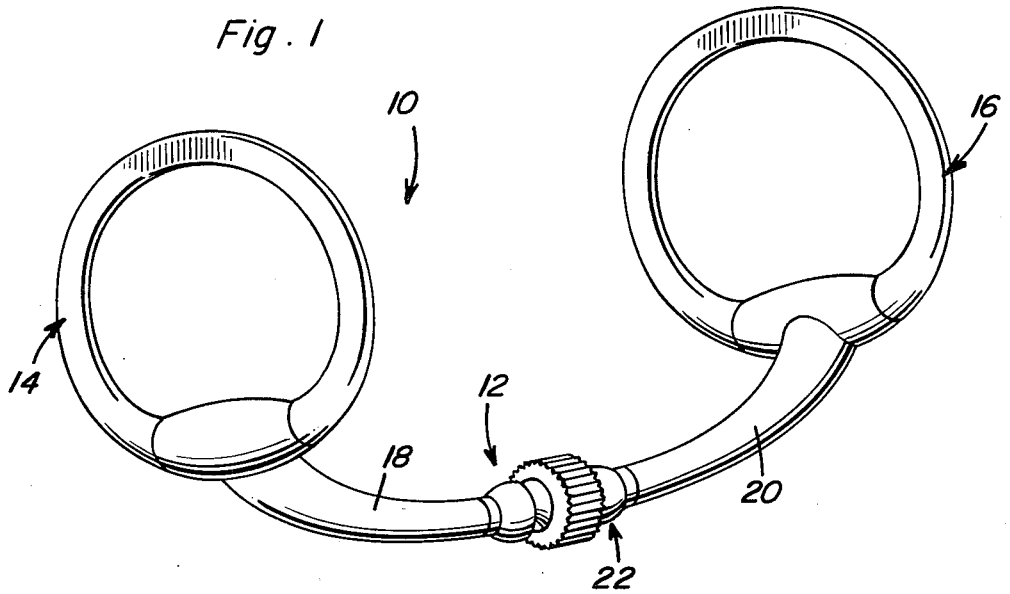
FIG. 1 is a perspective view showing a bridle bit according to the present invention.
Figure 2:
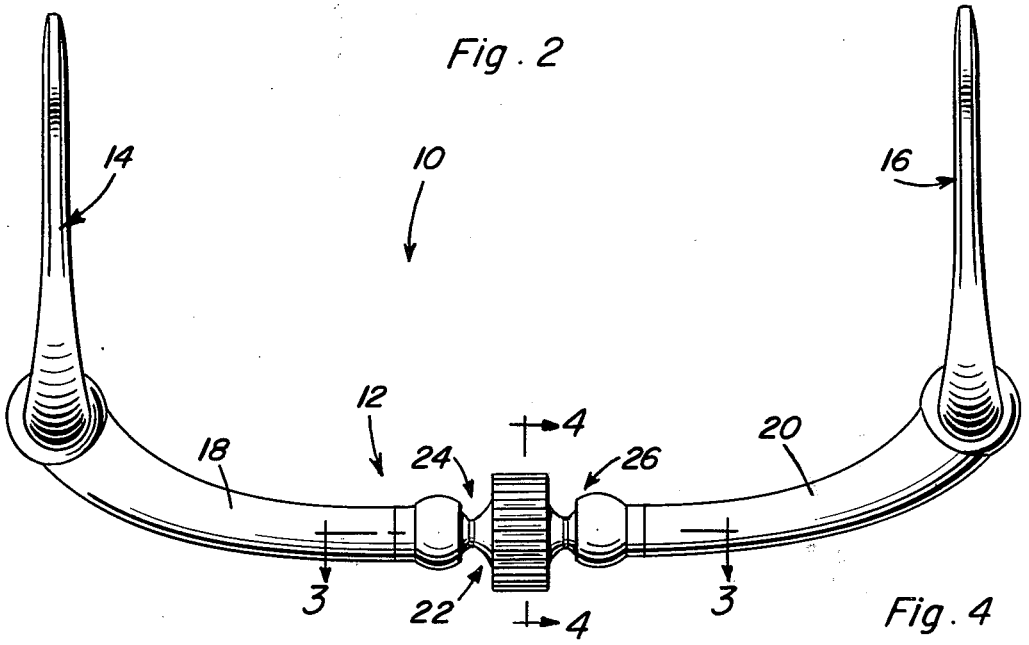
FIG. 2 is a side elevational view showing the bridle bit of FIG. 1.

Referring now more particularly to FIGS. 1 and 2 of the drawings, a bit 10 according to the present invention includes an elongated mouthpiece 12 provided at opposite ends with rings 14 and 16 which facilitate attachment of bit to a bridle (not shown). As can be readily seen from drawings, rings 14 and 16 are pivotally attached to mouthpiece 12 in a conventional manner.

Mouthpiece 12 includes a pair of longitudinally extending, substantially rigid arms 18 and 20, each of which arms 18, 20 being connected to a respective one of the rings 14, 16 as set out above. A center coupling member 22 is disposed between and connected to arms 18 and 20 in a manner to be discussed below so as to connect arms 18 and 20 to one another in an articulated manner.

Mouthpiece 12 further includes separate, spaced universal joints 24 and 26 arranged for connecting center coupling member 22 to each of the arms 18, 20. More specifically, each of the joints 24, 26 includes a ball and socket joint integral with coupling member 22 and detachably connected to the associated arms 18 and 20.

Figure 3:
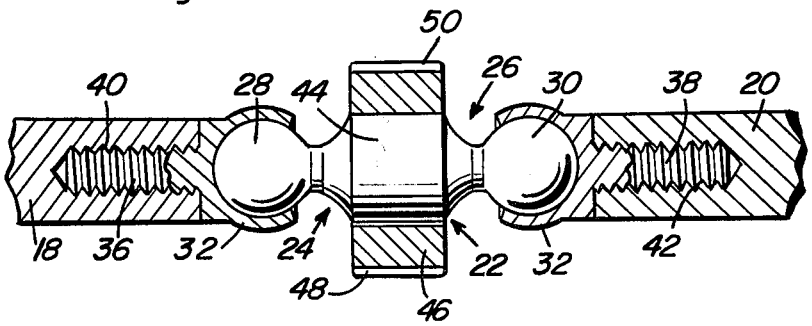
FIG. 3 is a fragmentary, sectional view, taken generally along the line 3—3 of FIG. 2, but drawn to a larger scale.

Referring now to FIG. 3 of the drawings, each of the ball and socket joints forming the joints 24, 26 includes a ball 28, 30 integral with coupling member 22, and a socket 32, 34 mating with the associated ball 28, 30 for forming a universal joint and having a screw threaded shank 36, 38 arranged extending directly away from the associated socket 32, 34, and an opening of the socket through which the mating ball 28, 30 extends. Each of the arms 18, 20 is provided with a screw threaded bore 40, 42 arranged threadingly engaging the associated screw threaded shank 36, 38 of the socket 32, 34 of an associated ball and socket universal joint 24, 26 for connecting the socket 32, 34 to the respective one of the arms 18, 20.

Coupling member 22 includes a substantially cylindrical surface 44 disposed between, and rigidly connected to, the balls 28, 30 of the universal joints 24, 26, for forming a bearing surface. A roller 46 is rotatably and slidably arranged on the cylindrical surface 44, with roller 46 cooperating with the joints 24, 26 to provide a smooth action and freedom of movement that will permit the bit 10 to function as a pacifier and virtually eliminate tongue protruding, teeth grinding, and lip smacking, due to extreme nervousness of a horse provided with a bit 10 while the horse is performing in a show ring, and the like.

Figure 4:
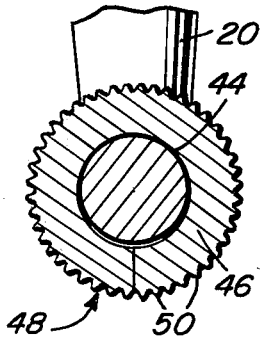
FIG. 4 is a fragmentary, sectional view taken generally along the line 4—4 of FIG. 2, but drawn to a larger scale.

Roller 46 advantageously is annular in shape and provided with a generally cylindrical outer periphery 48. This outer periphery 48 of roller 46 is desirably provided with knurling 50 to increase the friction of the outer periphery 48. As can best be seen from FIGS. 2 and 4 of the drawings, knurling 50 may take the form of the illustrated series of substantially parallel, transverse grooves and ridges.

As will be appreciated from the above description and from the drawings, a horse bit 10 according to the present invention is different than any other known snaffle because of the provision of the double ball and socket joint with two way roller at the center coupling which provides greater freedom of movement and a smoother action than is attainable with known snaffles. This type of joint acts as a pacifier, eliminating such problems as: grinding of the horse's teeth, protruding of the horse's tongue, smacking of the horse's lips, chewing on the bit by the horse, release of tension brought on by sheer nervousness while the horse is performing in a show ring, and the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a bit for horses which includes an elongated mouthpiece provided at opposite ends with respective attachment means for attaching a bridle to the bit, the improvement wherein the mouthpiece comprises, in combination:

a. a pair of longitudinally extending, substantially rigid arms, each of the arms being connected to a respective one of the attachment means;

b. a center coupling member disposed between and connected to the arms; and c. the mouthpiece further including separate, spaced joint means for connecting the center coupling member to each of the arms for universal movement between the coupling member and the respective arms, each of the joint means including a ball and socket joint means permanently attached integral with the coupling member and detachably connected to the associated one of the arms, each ball and socket means joint including a ball integral with the coupling member and a socket means mating with the ball and forming a universal joint therewith, and the coupling member including a substantially cylindrical surface disposed between, and rigidly connected to, the balls of the joint means, and a roller rotatably and slidably arranged on the cylindrical surface, the roller cooperating with the joint means to provide a smooth action and freedom of movement that will permit the bit to function as a pacifier and eliminate such behavior as tongue protruding, teeth grinding, and lip smacking by an associated animal due to extreme nervousness of the animal.

2. A structure as defined in claim 1, wherein the means has a screw threaded shank extending directly away from the means, and from an opening of the means into which the ball is inserted, with each of the arms being provided with a screw threaded bore threadingly engaging the screw threaded shank of the means of an associated joint for connecting the socket to the respective one of the arms.

3. A structure as defined in claim 1, wherein the roller in annular in shape with a generally cylindrical outer periphery, the outer periphery of the roller being knurled to increase the friction of the outer periphery and facilitate grasping of the roller by the teeth of an associated animal. pg,11

4. A structure as defined in claim 3, wherein the socket means has a screw threaded shank extending directly away from the socket means, and from an opening of the socket means into which the ball is inserted, with each of the arms being provided with a screw threaded bore threadingly engaging the screw threaded shank of the socket of an associated joint for connecting the socket means to the respective one of the arms.

* * * * *